United States Patent [19]

Isoard et al.

[11] 3,982,412

[45] Sept. 28, 1976

[54] YARN HANDLING PNEUMATIC DEVICE

[75] Inventors: Bernard Isoard, Ecully; Paul Juppet, Lyon, both of France

[73] Assignee: Rhone-Poulenc-Textile, Paris, France

[22] Filed: Dec. 9, 1974

[21] Appl. No.: 531,065

[30] Foreign Application Priority Data

| | | |
|---|---|---|
| Dec. 13, 1973 | France | 73.44960 |
| Oct. 1, 1974 | France | 74.33252 |
| Oct. 1, 1974 | France | 74.33251 |

[52] U.S. Cl. ..... 68/200; 28/1.4; 28/62; 34/156; 57/34 B; 68/6; 83/98; 226/97

[51] Int. Cl.[2] ..... D06B 1/08; B65H 17/32

[58] Field of Search ..... 28/1.4, 62; 68/6, 200; 226/97; 83/98, 402; 34/156; 57/34 B, 157 F

[56] References Cited

UNITED STATES PATENTS

| | | | |
|---|---|---|---|
| 3,169,296 | 2/1965 | Clendening | 28/72.12 X |
| 3,244,142 | 4/1966 | Walker | 68/200 X |
| 3,261,071 | 7/1966 | Clendening et al. | 28/1.4 |
| 3,286,896 | 11/1966 | Kinney | 226/97 |
| 3,468,114 | 9/1969 | Jackson | 28/1.4 X |
| 3,525,134 | 8/1970 | Coon | 28/1.4 |
| 3,574,249 | 4/1971 | Cannon | 28/1.4 |
| 3,703,751 | 11/1972 | Bowen | 28/1.4 |
| 3,727,274 | 4/1973 | White | 28/1.4 |

*Primary Examiner*—Philip R. Coe
*Attorney, Agent, or Firm*—Sherman & Shalloway

[57] ABSTRACT

This invention relates to a device for the transfer and the treatment of textile yarns comprising a pneumatic means comprising a body pierced from top to bottom with a channel of transversal section, preferably oblong the surface of said body increasing from upstream to downstream, said body being slit in the forepart to make the channel communicate with the outside on substantially its whole length along the generatrix of channel, and a higher part provided with at least a tubular member allowing a fluid to be fed to at least two orifices, parallel to the axis of the nozzle channel, said tubular members communicating with the higher part of said channel by means of a chamber, and a slot for permitting the passage of yarn from the outside towards said channel.

15 Claims, 13 Drawing Figures

YARN HANDLING PNEUMATIC DEVICE

BACKGROUND OF THE INVENTION

This invention relates to a pneumatic device for handling yarns and more specifically, to such devices for handling yarn at high speeds.

French Pat. No. 2,086,991 and U.S. Pat. Nos. 2,677,964, 3,094,262 and 3,156,395 are illustrative of prior art pneumatic devices utilized for yarn handling; however, the pneumatic devices of these patents have the disadvantages of not operating satisfactorily when used for yarn moving at speeds of 2,000 meters per minute. The primary reasons for the failure of these pneumatic devices to properly handle yarn moving at high speeds are that the devices either exert insufficient traction on the yarn as it is moving through the device or they do not provided adequate suction to grip the yarn. Furthermore, the prior art devices normally operate with high air outputs and pressure which render them expensive to manufacture and difficult to manage while still failing to provide the required performance.

The device described in the French Pat. No. 2,086,991 allows yarns moving at higher speeds to be caught, for example at more than 20 m/sec, but only when this yarn is under low tension, for instance while sent to a waste collector during some handling on the spinning machine. However, such a device does not make it possible to catch a yarn moving forward at high speed while being under high tension as is the cause in a process integrating the spinning and drawing of yarns placed just before the taking-up position during the spinning-drawing operation. Particularly, when a take-up bobbin is completed, it is not possible to catch the yarn during high speed spinning with one of the prior art devices for deposing it on the new empty bobbin. It is then necessary to cut the yarn above the take-up position and to send it to a waste nozzle during doffing. When the new empty bobbin is in position, the yarn is again taken by the handling device at the waste nozzle inlet and run through the guides placed above the winder before it is laid on the empty bobbin.

It is also known according to French Pat. No. 1,487,627 to use a filament driving device comprising a tube provided with a slot having knives and pierced with jets for feeding air coming from a jacket slantwise towards a nozzle axis. However, such a nozzle is noisy, requires space and is not efficient, because the air jet kinetic energy cannot be properly used, the yarn can only be inserted into the nozzle by a depression created which impedes high speed air circulation and finally, the yarn length subjected to this depression is limited to the slot length. Consequently, the fluid feed needed is very high and that the nozzle cannot catch a yarn under tension at high speed.

SUMMARY OF THE INVENTION

Accordingly, it is an object of the present invention to provide a pneumatic device capable of handling yarns moving at high speeds.

The device according to this invention consists of a nozzle having a body pierced from top to bottom with a channel having a cross-section which is preferably oblong. The surface of this cross-section increases from upstream to downstream, the body being slitted in the forepart to make the channel communicate with the outside on nearly the entire length, along a generatrix of the channel and of an upper part which is provided at least one tubular means for allowing the admission of a fluid, preferably a gas. At least two orifices are provided, preferably parallel to the nozzle channel axis for permitting the tubular means to communicate with the upper part of the channel by means of a chamber and at least one slot for allowing passage of the yarn from the outside towards the channel.

By "oblong" section are meant all elongated sections, such as those represented by a rectangle, a rectangle with rounded angles or the envelope of a circle, the center of which is displaced along a segment OO'.

Alternately, for some treatments, the channel section may also be circular or square, although preferably it is an oblong section such that the fluid section at the nozzle outlet is similar to a sheet of air which is easily deflected afterwards by a device using the coanda effect.

From upstream to downstream, the surface of the channel section increases, either by an increase of one or the other axis of this section, or by an increase of both axis simultaneously. Preferably, the increase of at least one axis is such that the channel slope is lower than 10% and preferably of 1–6%. However, in some cases of steam treatment, the channel section may be constant without departing from the scope of the invention.

The nozzle body is slit in the forepart to make the channel communicate with the outside on its total length along a generatrix of the channel. This slot allows the insertion of the yarn into the nozzle even if the yarn is under tension. Particularly, it makes it possible to catch a yarn moving at high speed, that is, at least 50 m/s and up to 100 m/s and more, under a tension of 20–50 g.

Notably, this thin slot with inlet chamfer has great reliability makes it possible to catch a yarn which in addition to its high speed longitudinal motion is also subjected to a transversal motion at a speed about 10–15 m/s and more.

At the lower part of this slot, there may be disposed a stationary or moving cutting blade or both, and preferably, a ribbon blade which can be box stored and the part used which may be renewed on every cutting by the ribbon's continuous motion in front of the cutting position or any other cutting device, such as a heating blade, in order to complete the catching mechanism, notably for a fine denier yarn.

The upper part of the nozzle is provided with at least a fluid inlet pipe which can be arranged laterally and communicate with at least one chamber, the lower wall of which is pierced with at least two small orifices through which the fluid is introduced into the upper part of the nozzle channel, preferably in a direction parallel to its axis. This fluid injection in a direction parallel to the axis of the nozzle channel is more efficient than if it were in an oblique direction.

When there are 2 or 3 orifices, these should be placed as close as possible to the channel longitudinal axis. When there are more than 3 orifices, all or nearly all these orifices should preferably be arranged on two lines situated on both sides of and as close as possible to the major axis of the oblong section of the channel. In addition, said upper part comprises a vertical slot for permitting the passage of the yarn coming from the top of the nozzle and its introduction into the channel of this nozzle.

It is understood, by yarn will be meant as well as a fine denier yarn constituted by a few individual filaments, the count of which may vary from 10 dtex or even less to some hundred dtex, as a two constituted by several thousands of individual filaments, the total count of which being, for example, 15 to 30 g/m or ktex.

The nozzle according to this invention may be supplied by any hot or cold liquid or gaseous fluid desired, for example, cold compressed air when the nozzle is only used as a means for transferring yarns, hot air, steam at high temperature, mixtures of air and steam, for thermal treatments, treatment liquids or gas, such as plasticizers, solutions, emulsions or suspensions of various treatment products, such as dye solutions, oiling agent emulsions, able to improve the sliding or to decrease the static electricity of yarns treated.

When the nozzle according to this invention is supplied with a hot fluid, it may be advantageous to provide it with a device for allowing the slot to be choked after the yarn is introduced in order to avoid heat losses. Such a device may consist, for instance, of a hinged or sliding door. When the body of the nozzle is circular, it may also have the form of a hollow cylindrical hood which provided with a longitudinal slot able to fit completely into the body of the nozzle. In this case, the hood slit is made to coincide with the nozzle slit on introducing the yarn, then the hood is made to rotate a fraction of a revolution in order that both slots do not coincide any more during the nozzle's functioning for thermal treatment.

Nozzle dimensions may vary within rather wide limits according to the kind and the speed of the yarn to be handled.

The particular form of this nozzle makes its use possible for yarns moving at medium speeds, for example 10 m/s, as well as yarns moving at high speeds, for example 50–100 m/s and even more.

In such a nozzle, flow conditions are improved so that, for the same efficiency, the air or fluid consumption is lower than that of known nozzles or at equal consumption, its efficiency and speed performances are increased. Its better efficiency allowing its dimensions to be appreciably decreased in relation to those of prior art nozzles and the form of its channel, enabling it to be inserted into a rather flat, nearly parallelepiped body so as to permit the juxtaposition of a great number of these nozzles within a very small space.

In addition, its low thickness (which is usually about 10 mm thick) makes it possible to use it as a very simply means for catching side by side yarns which are about a 10 mm distant from each other.

Therefore, such a nozzle may be used as well in a stationary device for the passage of yarns from a first treatment device to a second treatment device, as in such a device, but this time moving for automatic or manual use.

Thus, for moving yarns it may be an efficient traction means, a very simple and very efficient catching means, a deflection means when associated with a coanda type device, for example, an hydroextraction means for a yarn impregnated with liquid or a treatment means.

When the nozzle of this invention is used as a catching means, the relative motion of the yarn and of the nozzle is carried out preferably by a means external to the nozzle, by motion either of the yarn towards the nozzle, or the nozzle towards the yarn, or still of both moving simultaneously.

Also, the yarn can pass easily through the slot and is caught instantaneously along the nozzle length in air air jet at a speed capable of giving a yarn tension sufficient for its processing.

Also, the suction is not considered as the yarn catching means, but only as an assistant for its passage through the nozzle to avoid the need of an accurate relative positioning of nozzle-yarn.

Thus, a strong depression in the slot is not needed. The corresponding energy being so saved so that this nozzle is much more efficient than prior art nozzles. In addition, on account of its low air consumption, the noise level emitted by the nozzle is lower than that of the prior art nozzles.

When the nozzle according to this invention is used as an automatic or manual yarn handling means, it usually includes cutting means such as a stationary or a moving blade or both. The motion in the case of a moving blade is usually started by a rapid displacement means and preferably a ribbon blade some hundredth millimeter thick, possibly box stored, and the part of which is used can be renewed after every cutting by continuous passage of the ribbon in front of the cutting position. The cutting means, of course, is selected according to the nature and the characteristics of the yarn drawn through the nozzle.

These cutting means are disposed preferably on the forepart of the slot and in the downstream area of the nozzle body, that is between the downstream end and at a point situated at about ¾ of the nozzle body length from said end. Also, the positioning of the cutting means may be selected according to the nature and the characteristics of the yarn to be cut. For a fine denier yarn which is easy to be cut, the cutting means should be disposed as near as possible the downstream end, in order to provide a great slot length upstream acting as catching means. On the contrary, for a coarse denier yarn, with a great number of filaments and which is difficult to be cut, the cutting means should be placed as far as possible, that is about ¾ the nozzle body length from the downstream end. Coarser yarns are more easily caught and the upper part of the slot is designed to take the yarn can be shorter, so that the yarn driven by the air jet describes a great loop down to the downstream end of the channel. The air jet exerting a high tensile strength upon this loop makes the yarn press strongly against the cutting blade, thus facilitating its cutting.

The textile yarn transfer device according to this invention is more efficient than all of the prior art devices. In fact, most of prior art devices only make it possible to catch yarns moving at low speeds, in the order of 10 m/sec and under low tension.

With the device according to this invention, it is possible to catch the yarn not only at high speeds but also under high tension, that is, it is possible to take the yarn during winding just before the bobbin is completed and to depose it directly on the empty bobbin, without needing to make the yarn again pass through all the guides. Thus, the time required for the bobbin replacement is very reduced and therefore a much lower quantity of yarn goes to waste, which is economically interesting, above all when operating at high speeds.

With the present manual or automatic yarn transfer device, it is possible, for example, to catch a 15 to 300 dtex yarn running at speeds of 50 to 100 m/sec and even more, submitted, in addition, to a traversing motion of 10 to 15 m/sec and under a tension comprising between 20 and 50 g. To catch the yarn, it is then necessary to draw the device near to the yarn by displacing it in the plane defined by the longitudinal and the lateral motion of the yarn.

In another embodiment of the invention, the nozzle is fixed between two yarn treatment devices, and the yarn is continuously passed through the nozzle. The driving fluid is fed into the nozzle, either for introducing the yarn for the first time, or when some handling on a second device without risk of producing yarn breaks. Thus, the nozzle may be used as a safety means, avoiding having to take the yarn back on the first device in case of breaking on the second device.

Therefore, the nozzle according to this invention may be used for thermal treatments, dyeing, oiling or any other treatment desired. For example, if the nozzle is used for thermal treatment of freshly spun bicomponent yarns, it can allow a yarn crimp to be developed under excellent conditions and very rapidly.

Other objects and advantages will become apparent from the following description of the preferred embodiments taken in conjunction with the accompanying drawings.

DESCRIPTION OF THE PREFERRED EMBODIMENTS

Figure 1:
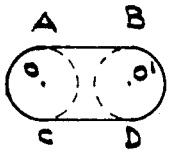
FIGS. 1 to 3 illustrate various forms of oblong sections for the channel of the device of the present invention.

FIG. 1 illustrates one form of cross-section of the channel for the nozzle of the transfer device of the present invention. The periphery of the channel section is formed by a semi-circle O and a semi-circle O′ joined one to each other by the segments AB and CD. Nozzles having such channels are preferred for the transfer of fine denier yarns. In such nozzles, usually, the circle O remains equal to itself, while the distance OO′ increases in the channel from upstream to downstream.

Figure 2:
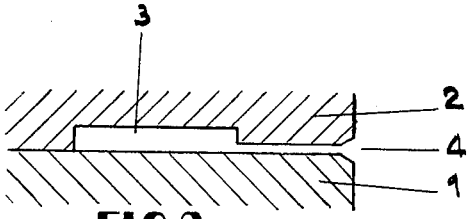

In FIG. 2, there is seen a sectional view of a nozzle with a rectangular section of the transfer device of the present invention. In order to make machining more economic, this nozzle body may consist of a solid part 1 not machined in its central part, fixed to a part 2 in which the total channel length 3 and the total slot length 4 are machined, as represented in FIG. 2, this machining type being of course not restrictive.

Figure 3:
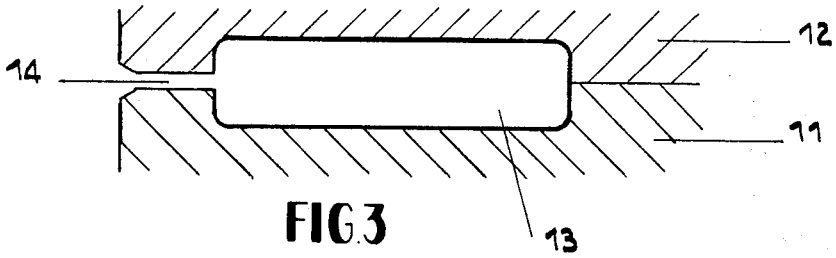

In FIG. 3, there is seen a sectional view of a rectangular section nozzle with rounded angles of the transfer device of the present invention. In this figure, the nozzle body comprises two parts 11 and 12 which are machined symmetrically. The juxtaposition of these two parts provides the channel 13 and the slot 14 between them.

Nozzles with channels having a shape according to FIGS. 2 or 3, are particularly advantageous for the transfer of coarse denier yarns or tows.

Figure 4:
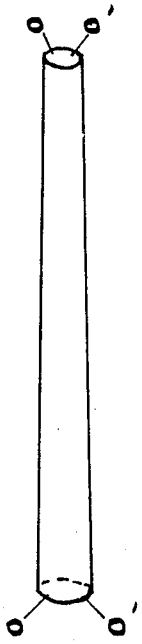
FIG. 4 illustrates a channel taken as a solid, with a section according to FIG. 1.

As shown in FIG. 4, the distance OO′ of the channel of FIG. 1 increases from upstream to downstream of the channel.

Figure 5:
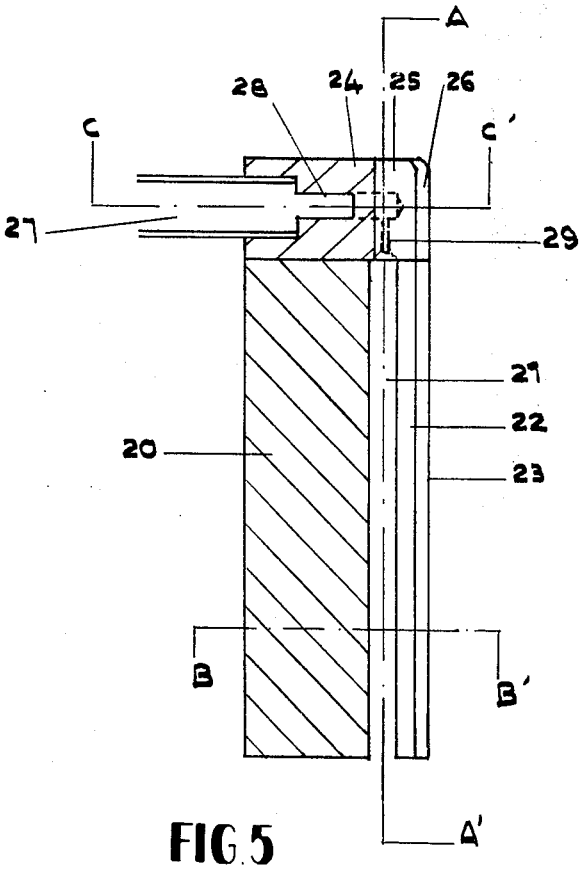
FIG. 5 is a longitudinal sectional view of a nozzle according to the invention.

FIG. 5 illustrates a nozzle body 20, the channel 21, one of the two lips 22 of the longitudinal slot, the edge 23 of which is wide-mounted to facilitate yarn introduction. The higher part 24 of this nozzle is slit from top to bottom in 25 and the slot edge is wide-mounted in 26. This higher part 24 is provided with a gas or air admission pipe 27 communicating with a chamber 28, the part of which is situated on both sides of the slot 25 is represented in dotted line. The higher part 24 is pierced with two orifices one of which is represented by a dotted line in 29 through which the air of chamber 28 is injected into the upper part of the channel 21.

Figure 6:
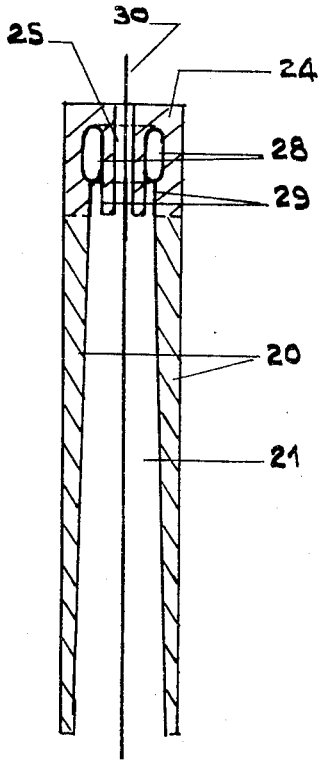
FIG. 6 is another longitudinal sectional view along AA′ of the nozzle of FIG. 5.

FIG. 6 shows the nozzle body 20, the channel 21 the major axis of the transversal section of which increases from upstream to downstream, the higher part 24, the slot 25, the chamber 28, the non-visible back part of which is represented in dotted line, orifices 29 injecting air from the chamber 28 into the upper part of the channel 21 and finally the yarn 30 going through the nozzle from top to bottom.

Figure 7:
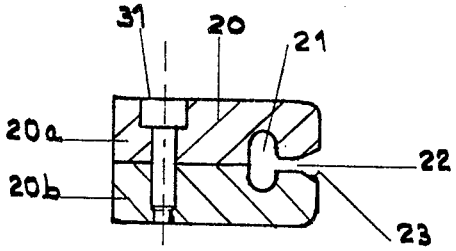
FIGS. 7 and 8 are transversal sectional views of the nozzle of FIG. 5 taken along line BB′ and CC′, respectively.

FIG. 7 is a sectional view of the nozzle according to FIG. 5 showing the body 20 which for an easier machining consists, in this case, of two parts 20*a* and 20*b* made integral by a screw 31. The channel 21, the slot 22 and the bell-mouthed part 23 are also shown.

Figure 8:
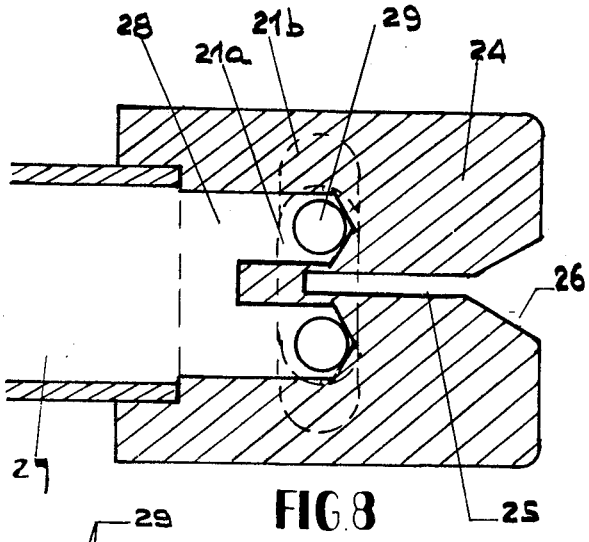

FIG. 8 is a sectional view taken along line CC′ of the nozzle according to FIG. 5 but on a major scale in order to make the understanding easier. This figure shows the higher part 24, the slot 25 and its wide-mounted edge 26, the air supply pipe 27, the chamber 28, of a particular shape not to interfere with slot 25, orifices 29 allowing the air to pass from the chamber 28 to the upper part of the channel 21 shown in dotted line in 21*a*. In order to facilitate the understanding of the device, the lower extremity 21*b* of the channel 21 is also shown in this figure but in a dotted line for it cannot be seen on the sectional view.

Figure 9:
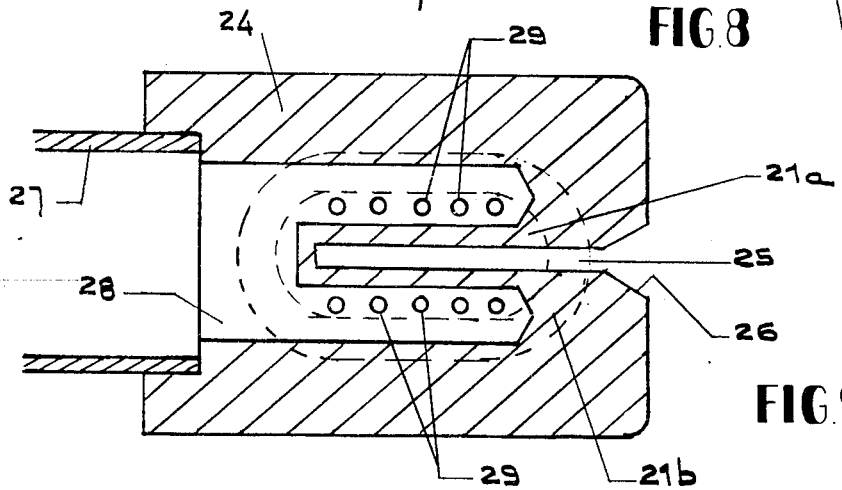
FIG. 9 is a transversal sectional view of the upper part of a nozzle of this invention, the channel of which has a very elongated section according to FIG. 3.

FIG. 9 also shows the slot 25, the pipe 27, the chamber 28, the orifices 29, disposed on two lines, the upper part of the channel in 21*a* and the lower end of the channel in 21*b*.

Figure 11:
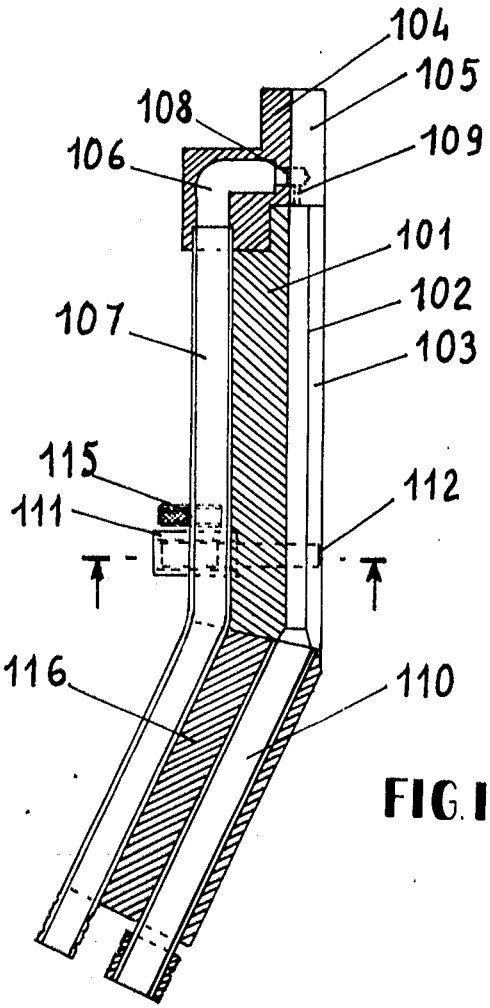
FIG. 11 is a longitudinal sectional view of a manual yarn transfer device according to the present invention.

The nozzle body 101, the channel 102, one of the two lips 103 of the longitudinal slot are shown in FIG. 11. The upper part 104 of this nozzle is slit from top to bottom in 105 and is provided with an air supply tube 106 communicating on the one hand with the tubular 107 connected to the piping by means of an opening and closing device (not shown) and on the other hand with a chamber 108 of which a part situated on both sides of the slot 105 is shown in dotted line. The upper part 104 is also pierced with two orifices of which one is shown in dotted line in 109 injecting air from the chamber 108 into the upper part of the channel 102. The tube 110 connects the downstream end of the channel 102 to the waste collector (not shown).

Figure 12:
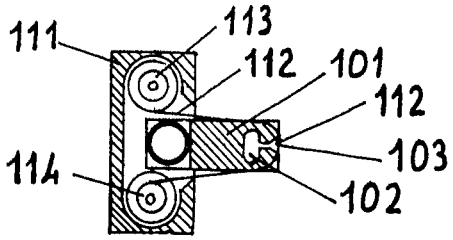
FIG. 12 is a transversal sectional view of the device according to FIG. 11 at the level of yarn cutting means.

FIG. 12 is a sectional view of a cutting device, fixed to the downstream part of the nozzle.

It comprises a box 111 in which a cutting ribbon-like blade 112 runs from a first solid pulley 113 to a second hollow pulley 114 describing a travel around the nozzle body 101, thus locking the slot 103 on a small length. A button 115 allows the cutting blade to be moved forward by the worn length in order to make a new length of the fresh blade to appear.

Finally, the part 116 serves as a gripping handle of the apparatus. Preferably, it is placed obliquely in relation to the properly so-called nozzle axis in order to facilitate handlings and particularly to make it possible to draw the whole length of the nozzle as near as possible to the course of the yarn to be caught up to its complete enclosing.

Figure 13:
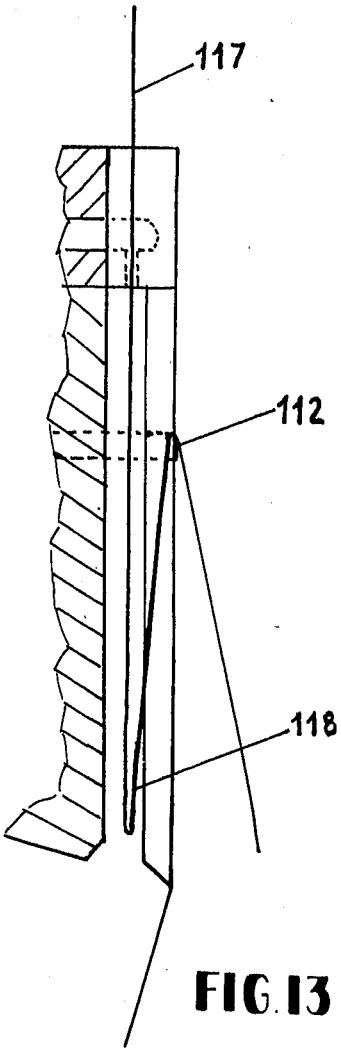
FIG. 13 illustrates the passage of yarn under an air stream in the device of FIG. 11.

FIG. 13 distinctly shows the passage of yarn 117 which under the action of the air jet describes a loop 118 down to the downstream end of the channel before passing onto the cutting blade 112. In this figure, the cutting blade is shown in a high position permitting coarse denier yarns to be cut.

The following examples are given for information to illustrate the invention and are not restrictive.

EXAMPLE 1

A nozzle according to FIGS. 5, 6, 7 and 8, of which the total height is 150 mm and the height of the body 20 is 137 mm is used. The channel has a section according to FIG. 1, the minor axis being 5 mm and the major axis 6 mm at the higher end and 9 mm at the lower end. Orifices 29 are 2.6 mm in diameter.

A 167 dtex polyester yarn is run through this nozzle and compressed air is fed into tubular 27 at the rate of 52 $Nm^3$/hour under a pressure of 6 bars.

At a speed of 50 m/s, the tensile stress on the yarn is 17 g and at a speed of 58 m/s it is 12 g.

EXAMPLES 2 to 8

A 167 dtex polyester yarn is run through a nozzle similar to that of Example 1, the total height was 170 mm and the orifices 29 being 2.6 mm in diameter, under different conditions of yarn passage speed and of air pressure and feed.

The yarn passage was good under all these conditions and the tensile stress on the yarn was recorded in the following table.

TABLE

| Example No. | Air feed $Nm^3$/hour | Yarn speed m/s | Tensile stress g |
|---|---|---|---|
| 2 | 40 | 40 | 12 |
| 3 | 40 | 50 | 11.3 |
| 4 | 45 | 50 | 13.2 |
| 5 | 45 | 60 | 11.8 |
| 6 | 50 | 50 | 16.2 |
| 7 | 50 | 65 | 13.2 |
| 8 | 60 | 70 | 18 |

Figure 10:
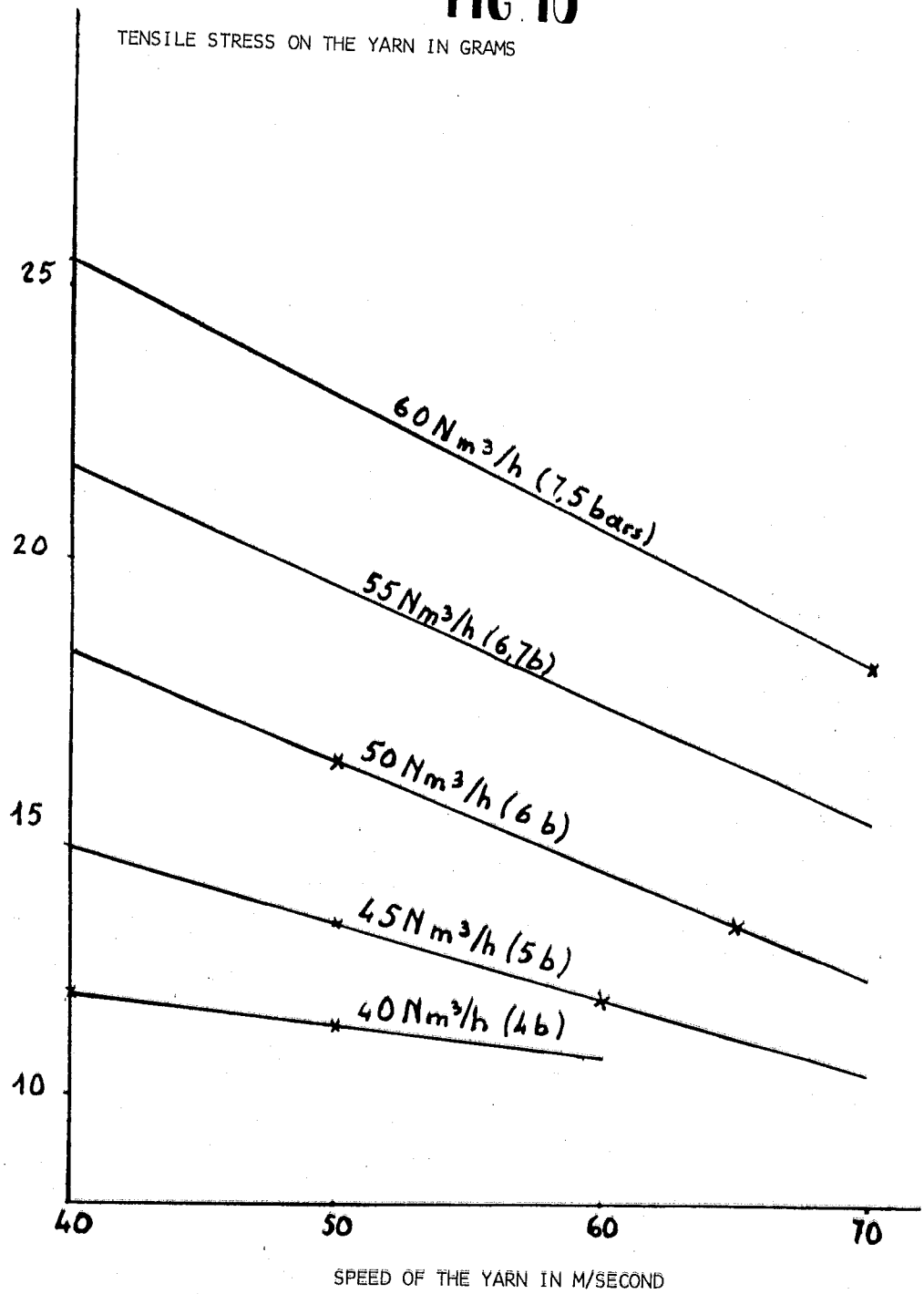
FIG. 10 is the curves illustrating the tensile stress on the yarn as a function of its speed for various feeds.

All these results were also gathered in the form of curves in FIG. 10. The curves show that by selecting a suitable pressure and a compressed air feed it is possible to transfer a yarn practically running at any speed and in particular at very high speeds such as higher than 70 m/s, and to remain in pressure and air feed areas quite acceptable, likewise, the tensile stresses remain sufficient in order to allow an easy transfer of the yarn from a treatment point to another while being insufficiently high to risk yarn breaking.

EXAMPLE 9

A nozzle according to Example 1 of which, however, the body 20 was 162 mm high was used. The channel had a section according to FIG. 1 of which the minor axis was 5 mm and the major axis was 7.5 mm is at the higher end and 10 mm at the lower end. Orifices 29 were 1.75 mm in diameter. The slot 22 was 0.7 mm thick.

A 2,300 dtex/136 filament carpet polyamide yarn was run through this nozzle.

With a yarn speed of 25 m/s, a yarn tension of
40 g for an air feed of 15 $Nm^3$/h or of
60 g for an air feed of 30 $Nm^3$/h is obtained.

EXAMPLE 10

A nozzle according to Example 1 wherein a body 20 of 170 mm high, was used. The channel had a section according to FIG. 1 of which the minor axis was 6 mm and the major axis varied between 7.5 mm at the upper end and 11.5 mm at the lower end. Orifices 29 were 3 mm in diameter. The slot 22 was 0.3 mm thick.

A 167 dtex polyester yarn was run through this nozzle.

For an air feed of 70 $Nm^3$/h, a yarn tension of
23 g for a speed of 50 m/s or of
21.5 g for a speed of 60 m/s was obtained.

EXAMPLE 11

A nozzle such as those illustrated in FIGS. 5, 6, 7 and 8 was used wherein the body was 65 mm high. The channel had a circular section 4 mm in diameter at the upper end and 5 mm at the lower end. The orifices were 0.8 mm in diameter.

This nozzle was fed with steam under a pressure of 12 bars.

A 160 dtex/30 filaments polyethyleneterephthalate yarn was run through this nozzle.

For a yarn speed of 50 m/s and a steam consumption of 9 kg/h, a yarn tension of 15 g was obtained.

In addition, the yarn temperature on leaving the nozzle was 130°C.

EXAMPLE 12

The same nozzle as in Example was used.

This nozzle was fed with steam under a pressure of 12 bars.

A bicomponent yarn was run through this nozzle. This 50/50 bicomponent yarn was made from a polyethyleneterephthalate or an intrinsic viscosity of 0.66 and a polybutyleneterephthalate cross-linked by 0.3% mole of trimethylolpropane in relation to the number of terephthalate links, the viscosity of which in the molten state at 260°C was 4,200 poises.

The characteristics of this yarn at the inlet and the outlet of this nozzle was as follows:

| | Inlet | Outlet |
|---|---|---|
| Count in dtex | 163 | 177 |
| Number of filaments | 32 | 32 |
| Tenacity g/tex | 28.2 | 27.6 |
| Elongation % | 26.9 | 38.0 |
| Shrinkage in hot water | 13.1 | 8.7 |
| Shrinkage in saturated steam at 130°C | 14.8 | 11.4 |
| Extensibility % | 375 | 12.3 |
| Half-uncrimping force in mg/tex | 6.35 | 68.5 |
| Half recrimping force in mg/tex | 4.57 | 51.7 |
| Number of half-waves/cm | 9.2 | 14.9 |

-continued

| | Inlet | Outlet |
|---|---|---|
| Modulus in g/tex | 162 | 587 |

EXAMPLE 13

A manual device such as illustrated in FIG. 11 in which the nozzle body 101 was 170 mm high with orifices (109) 2.6 mm in diameter was used. The channel 102 had an oval section of which the minor axis was 5 mm, the major axis was 6 mm at the higher end and 9 mm at the lower end.

Compressed air was fed through the tubular 107 at the rate of 50 $Nm^3$/hour and under a pressure of 6 bars.

This device makes it possible for instance to catch a 150 dtex/30 fil polyethyleneterephthalate yarn at a speed of 3,500 m/min under a tension of 25 g with perfect reliability.

Inasmuch as the present invention is subject to many variations, modifications and changes in detail, all matter described above or shown in the accompanying drawings is intended to be interpreted as illustrative and not in a limiting sense.

What we claim is:

1. A pneumatic yarn-handling nozzle comprising a body having a top portion and a bottom portion, a yarn passage extending from the top portion to the bottom portion, a slot formed in the body and extending along a generating line of the yarn passage and providing communication between the yarn passage and the exterior of the body for substantially the whole length of the yarn passage, said slot having a chamfered outer portion extending along the length thereof, said nozzle having an upper part with a chamber therein, a fluid inlet into the chamber and at least two fluid outlet orifices communicating said chamber with the yarn passage in the body, and a further slot in the upper part permitting the passage of the yarn from the exterior into the yarn passage, the cross-section of the yarn passage increasing from the top portion toward the bottom portion.

2. A nozzle according to claim 1, wherein the yarn passage is of circular transverse cross-section.

3. A nozzle according to claim 1, wherein the yarn passage is of elongate cross-section having a major axis and a minor axis.

4. A nozzle according to claim 3, wherein the cross-section of the yarn passage is formed by two semi-circular arcs joined by two straight lines tangential thereto.

5. A nozzle according to claim 3, wherein the cross-section of the yarn passage is rectangular.

6. A nozzle according to claim 3, wherein the cross-section of the yarn passage is rectangular with rounded corners.

7. A nozzle according to claim 3, wherein the cross-section increases by an increase in both its major and minor axis dimension.

8. A nozzle according to claim 1 wherein the walls of the yarn passage have a slope of less than 10% to provide the increase in cross-section.

9. A nozzle according to claim 8, wherein the slope is between 1 and 6%.

10. A nozzle according to claim 1, wherein said at least two outlet orifices have axes substantially parallel to the direction of the yarn passage.

11. A nozzle according to claim 1, wherein a fluid feed tube is connected to the inlet of the chamber and a waste removal tube is connected to the bottom portion of the yarn passage, said fluid tube and waste removal tube extending alongside one another.

12. A nozzle according to claim 1, including a source of compressed air connected to said fluid inlet.

13. A nozzle according to claim 1 including a source of hot fluid connected to said fluid inlet.

14. A nozzle according to claim 1 including a source of a coloration fluid connected to said fluid inlet.

15. A nozzle according to claim 1 including a source of an oiling agent connected to said fluid inlet.

* * * * *